US005263090A

United States Patent [19]

Hughes

[11] Patent Number: 5,263,090

[45] Date of Patent: Nov. 16, 1993

[54] HEARING AID FILTER APPARATUS

[76] Inventor: Richard A. Hughes, 265-24 Carlisle St., Greencastle, Pa. 17225

[21] Appl. No.: 829,312

[22] Filed: Jan. 31, 1992

[51] Int. Cl.[5] ..... H04R 25/00

[52] U.S. Cl. ..... 381/69; 381/68; 381/68.7; 2/208

[58] Field of Search ..... 381/183, 187, 68.7, 381/68.6, 69; 2/208, 209, 423; 379/430

[56] References Cited

U.S. PATENT DOCUMENTS

| | | | |
|---|---|---|---|
| 993,620 | 5/1911 | Quinn | 2/209 |
| 2,325,150 | 7/1943 | Sahlmann | 2/209 |
| 2,597,508 | 5/1952 | Majewski | 2/209 |
| 2,615,169 | 10/1952 | Maxant | 2/209 |
| 2,975,244 | 3/1961 | Lehr | 381/68.7 |
| 4,702,345 | 10/1987 | Janssen et al. | 381/187 |
| 4,918,757 | 4/1990 | Janssen et al. | 381/68.3 |

*Primary Examiner*—Jin F. Ng
*Assistant Examiner*—Huyen D. Le
*Attorney, Agent, or Firm*—Hugh E. Smith

[57] ABSTRACT

An apparatus to effect coverage of a hearing aid housing received within a cavity of the sock housing to effect filtration of various airborne contaminants. A modification of the invention includes hair filaments arranged and mounted to the sock structure to effect coverage of the sock member and its camouflage.

2 Claims, 4 Drawing Sheets

HEARING AID FILTER APPARATUS

BACKGROUND OF THE INVENTION

1. Field of the Invention

The field of invention relates to hearing aid apparatus, and more particularly pertains to a new and improved hearing aid filter apparatus wherein the same is arranged to effect filtration of various airborne contaminants relative to a hearing aid housing.

2. Description of the Prior Art

Individuals frequently utilizing hearing aid and hearing aid amplification units in areas containing airborne contaminants and the like requires periodic and frequent cleanings of such hearing aid housings to maintain their efficient use. The instant invention attempts to overcome deficiencies of the prior art by providing a mesh sock structure arranged for ease of cleaning and removal relative to a hearing aid housing structure to permit effective filtration of various contaminants directed to the hearing aid housing. Prior art apparatus to dust filtration is exemplified in the U.S. Pat. No. 4,528,008 to Tagagi, et al.

U.S. Pat. No. 4,220,150 to King sets forth a nasal dust filtration arranged to be received within nasal passages to effect filtration of dust particles directed into the nasal cavity.

U.S. Pat. No. 3,605,387 to Margraf and U.S. Pat. No. 4,770,679 to Slaughter are further examples of dust filtration apparatus.

As such, it may be appreciated that there continues to be a need for a new and improved hearing aid filter apparatus as set forth by the instant invention which addresses both the problems of ease of use as well as effectiveness in construction in removal of airborne particles relative to a hearing aid housing structure and in this respect, the present invention substantially fulfills this need.

SUMMARY OF THE INVENTION

In view of the foregoing disadvantages inherent in the known types of hearing aid apparatus now present in the prior art, the present invention provides a hearing aid filter apparatus wherein the same is arranged for surroundingly containing a hearing aid housing therewithin for filtration of airborne contaminants. As such, the general purpose of the present invention, which will be described subsequently in greater detail, is to provide a new and improved hearing aid filter apparatus which has all the advantages of the prior art filter apparatus and none of the disadvantages.

To attain this, the present invention provides an apparatus to effect coverage of a hearing aid housing received within a cavity of the sock housing to effect filtration of various airborne contaminants. A modification of the invention includes hair filaments arranged and mounted to the sock structure to effect coverage of the sock member and its camouflage.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hearing aid filter apparatus which has all the advantages of the prior art filter apparatus and none of the disadvantages.

It is another object of the present invention to provide a new and improved hearing aid filter apparatus which may be easily and efficiently manufactured and marketed.

It is a further object of the present invention to provide a new and improved hearing aid filter apparatus which is of a durable and reliable construction.

An even further object of the present invention is to provide a new and improved hearing aid filter apparatus which is susceptible of a low cost of manufacture with regard to both materials and labor, and which accordingly is then susceptible of low prices of sale to the consuming public, thereby making such hearing aid filter apparatus economically available to the buying public.

Still yet another object of the present invention is to provide a new and improved hearing aid filter apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
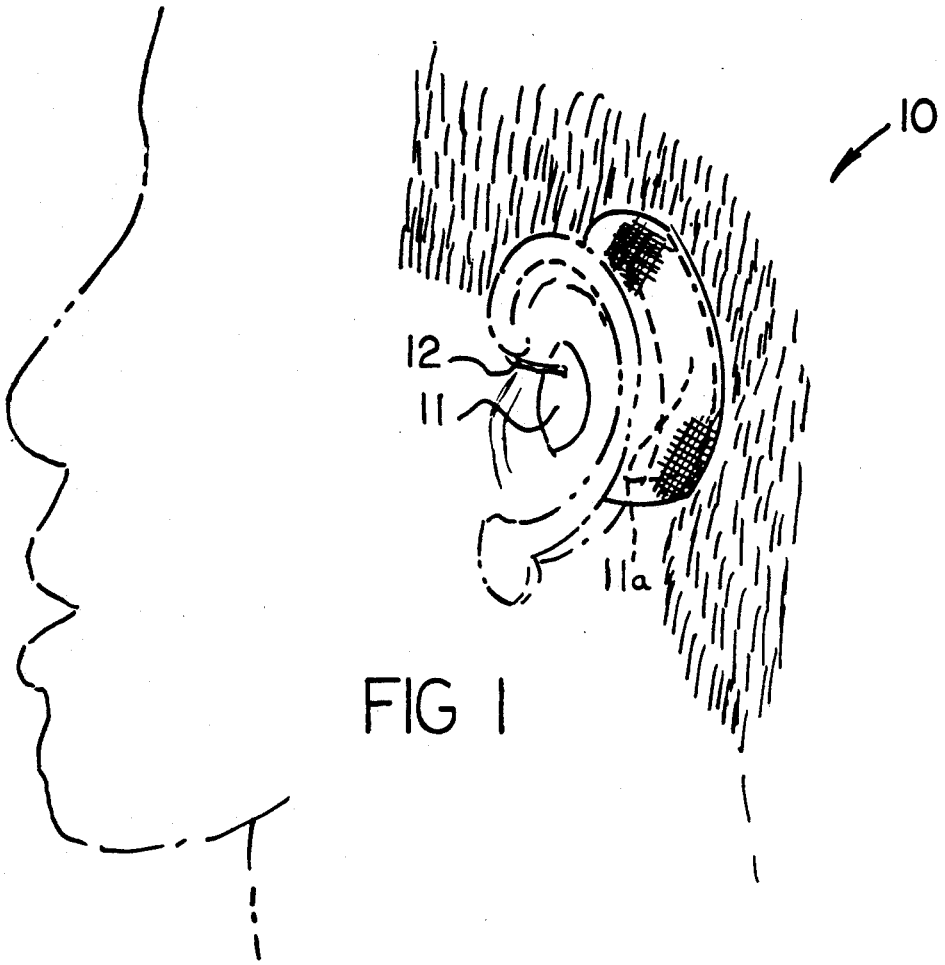
FIG. 1 is an orthographic side view of the invention in use.
Figure 2:
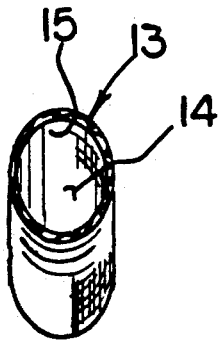
FIG. 2 is an orthographic end view of the instant invention.
Figure 3:
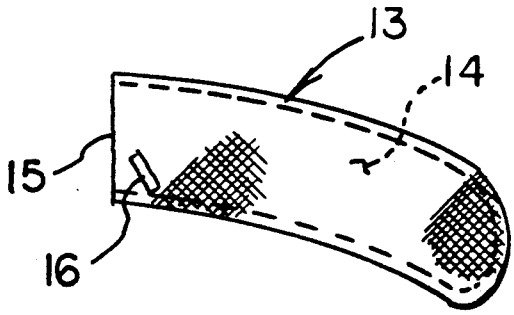
FIG. 3 is an orthographic side view of the invention.

With reference now to the drawings, and in particular to FIGS. 1 to 10 thereof, a new and improved hearing aid filter apparatus embodying the principles and concepts of the present invention and generally designated by the reference numerals 10, 10*a*, and 10*b* will be described.

More specifically, the hearing aid filter apparatus 10 of the instant invention essentially comprises a fibrous filter sock housing 13 formed of a mesh construction to effect filtration of airborne particles that is formed with a housing cavity 14 and a cavity entrance 15. A hearing aid member 11 is in operative communication with a hearing aid housing 11*a* positioned within the housing cavity 14. A slot 16 is directed through the housing 13 adjacent the entrance 15 to direct a hearing aid electrical communication member 12 between the hearing aid member 11 and the hearing aid housing 11*a*.

Figure 4:
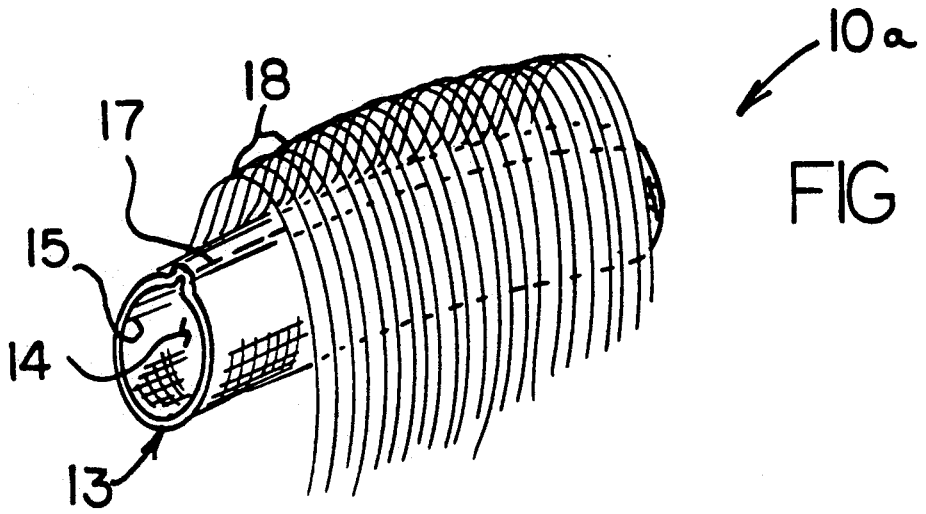
FIG. 4 is sets forth a modification of the invention.
Figure 5:
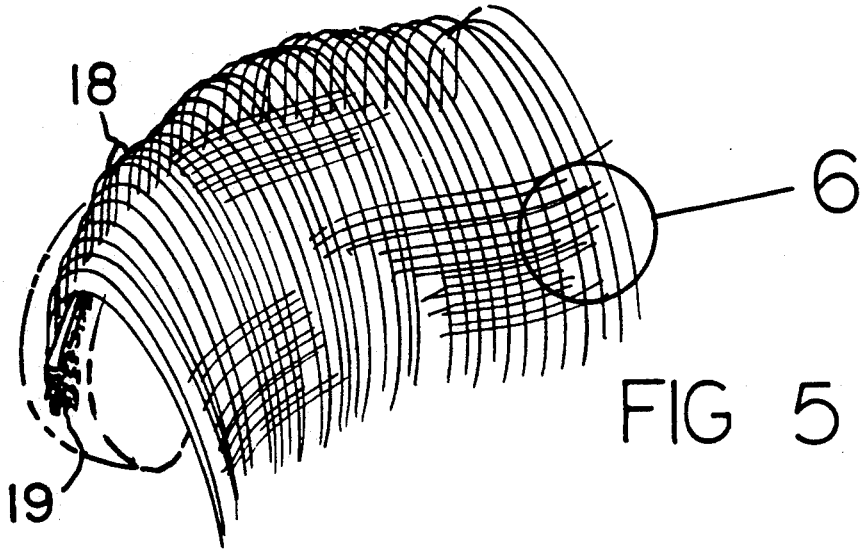
FIG. 5 is an isometric illustration of the modification of the invention utilizing a filtration primary web.
Figure 6:
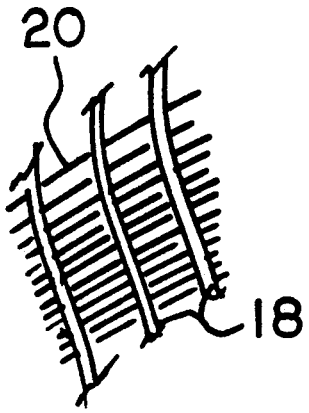
FIG. 6 is an orthographic enlarged view of section 6 as set forth in FIG. 5.
Figure 7:
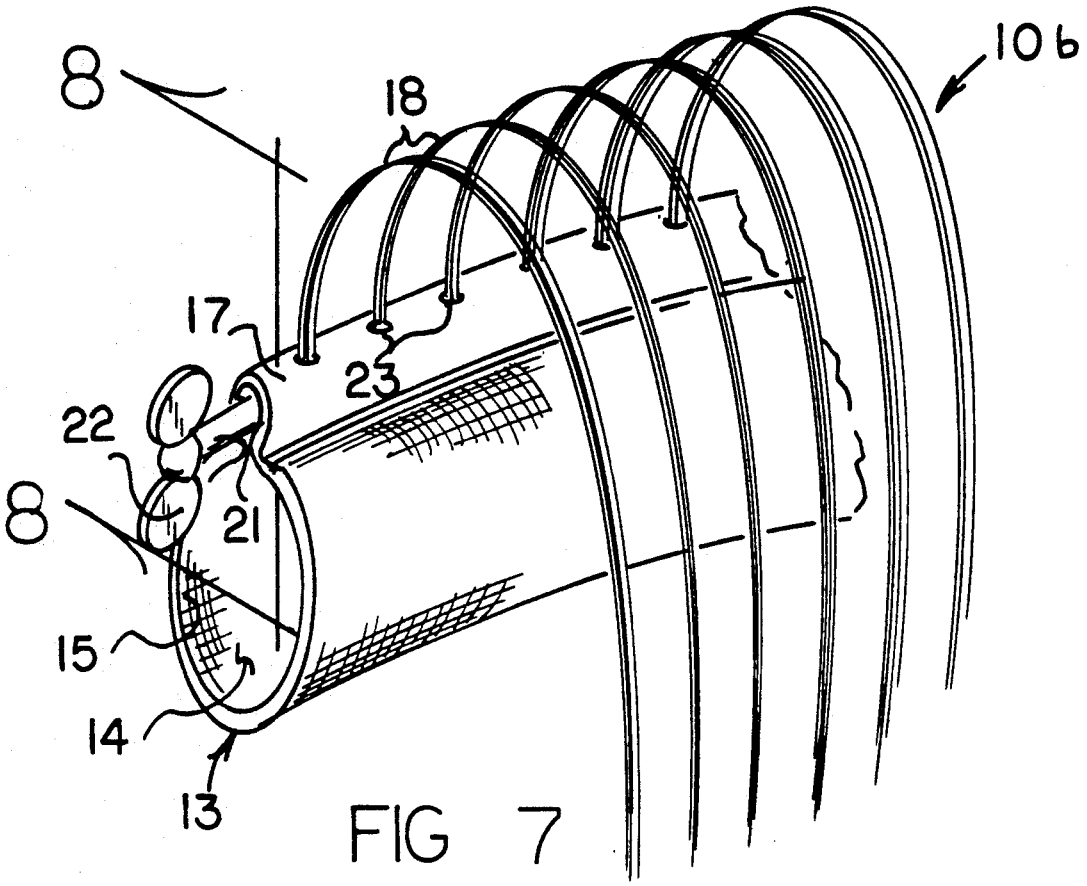
FIG. 7 is an isometric illustration of a further modification of the invention.
Figure 8:
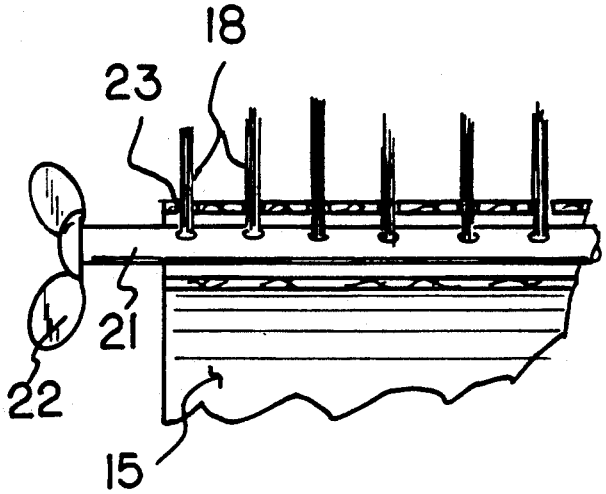
FIG. 8 is an orthographic view, taken along the lines 8—8 of FIG. 7 in the direction indicated by the arrows.
Figure 9:
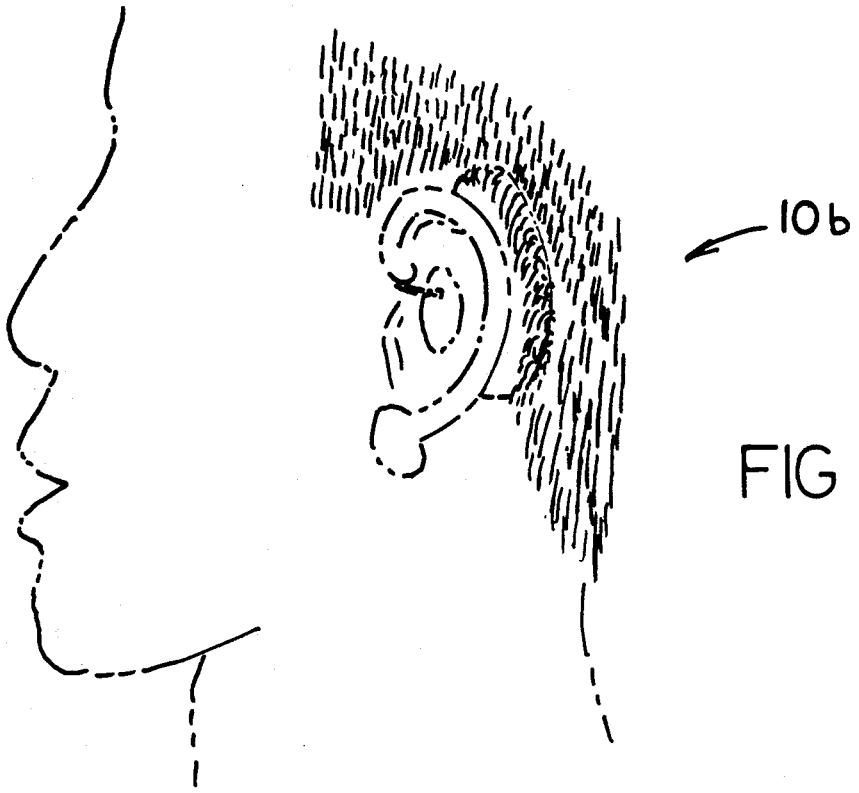
FIG. 9 is an orthographic side view of the apparatus as set forth in FIG. 7 in a first position.
Figure 10:
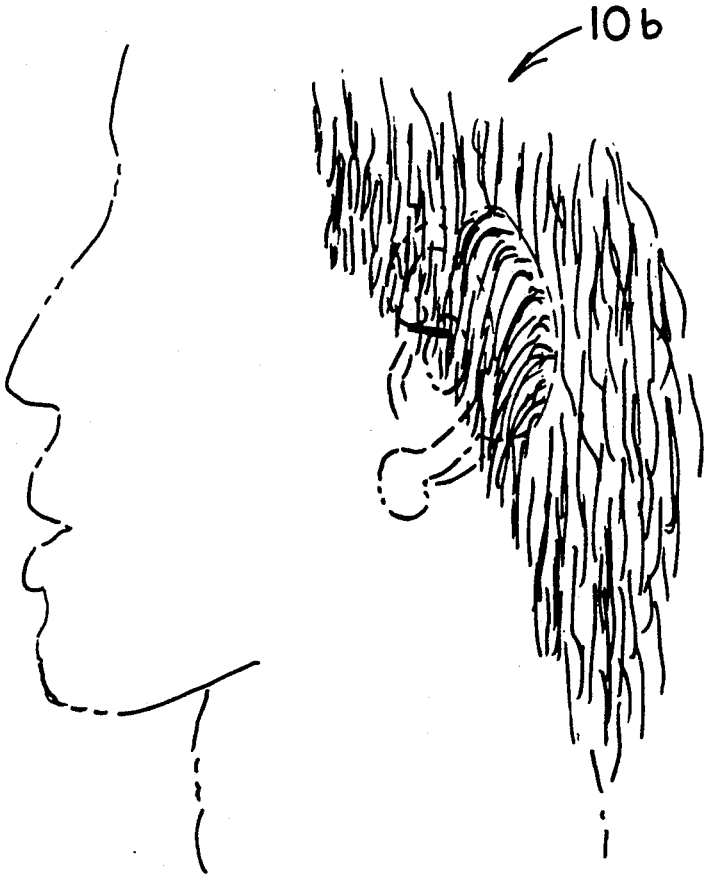
FIG. 10 is an orthographic side view of the apparatus as set forth in FIG. 7 in a second position for camouflage of the filter housing in an associated hearing aid member.

The apparatus 10*a*, as illustrated in the FIG. 4, utilizes a housing tubular rib 17 mounting a row of hair filaments 18 therealong coextensively with the rib. Alternatively, a hook and loop fastener strip 19, as illustrated in FIG. 5, may be arranged for securement to the tubular rib 17 in a selective manner. Hair filaments 18 are effected for camouflaging of the sock housing 13. Further, a mesh web 20 may be mounted to a rear surface of the hair filaments 18, as illustrated in the FIG. 5, to provide for a primary filtration of airborne particles in association with the secondary filtration of the sock housing 13.

The further modified apparatus 10*b*, as illustrated in the FIGS. 7-10, is arranged with the tubular rib 17 including a spindle 21 rotatably mounted therewithin. The spindle includes a spindle handle 22 positioned to a free distal end of the spindle 21 exteriorly of the rib 17, with the spindles 21 mounting the lower distal ends of each of the hair filaments 18 thereto. Each of the hair filaments 18 is directed through tubular rib ports 23 extending through the tubular rib 17 to permit selective winding of the hair filaments 18 about the spindle 21 to provide for selective projection of the hair filaments from the housing 13, in a manner as illustrated in the FIGS. 9 and 10, to provide for selective camouflage as required in association with a particular hair style of an individual to accommodate that individual's hair style.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hearing aid filter apparatus for reception of a hearing aid housing therewithin, wherein the hearing aid housing includes an electrical connector member in communication with a hearing aid member for reception within an individual's ear, wherein the apparatus comprises, an elongate fibrous filter sock housing formed of a mesh web, the sock housing including a cavity therewithin for receiving of the hearing aid housing therewithin, the cavity including an entrance directed through a first end of the sock housing, and a slot directed through the filter sock housing for directing the electrical connection member therethrough, and the filter sock housing includes an elongate housing tubular rib coextensive with the filter sock housing, the tubular rib including a row of hair filaments directed therealong, and the tubular rib includes a plurality of tubular rib ports, and each of the rib ports includes a hair filament directed therethrough, and each hair filament includes a hair filament lower distal end, and a spindle rotatably mounted within the tubular rib, and each hair filament lower distal end mounted to the spindle within the tubular rib.

2. An apparatus as set forth in claim 1 wherein the spindle includes a handle positioned exteriorly of the tubular rib and fixedly mounted to the spindle exteriorly of the tubular rib permitting rotation of the spindle and winding of the filaments about the spindle for effecting selective projection of a predetermined length of each hair filament relative to the tubular rib.

* * * * *